US010323380B2

(12) United States Patent
Sasaoka et al.

(10) Patent No.: US 10,323,380 B2
(45) Date of Patent: Jun. 18, 2019

(54) COUPLING PIN EXTRACTING APPARATUS AND WORKING MACHINE PROVIDED WITH SAME

(71) Applicant: KOBELCO CONSTRUCTION MACHINERY CO., LTD., Hiroshima-shi (JP)

(72) Inventors: Yoshio Sasaoka, Hyogo (JP); Hitoshi Nakamura, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 59 days.

(21) Appl. No.: 15/620,030

(22) Filed: Jun. 12, 2017

(65) Prior Publication Data

US 2017/0362793 A1 Dec. 21, 2017

(30) Foreign Application Priority Data

Jun. 17, 2016 (JP) ..... 2016-121131

(51) Int. Cl.
*E02F 3/36* (2006.01)
*E02F 9/00* (2006.01)
*E02F 3/627* (2006.01)

(52) U.S. Cl.
CPC ..... *E02F 3/3663* (2013.01); *E02F 3/3622* (2013.01); *E02F 3/627* (2013.01); *E02F 9/006* (2013.01); *E02F 3/3609* (2013.01)

(58) Field of Classification Search
CPC ..... B66C 23/70; B66C 23/68; B66C 23/708; B66C 23/66; B66C 23/42; B66C 23/62; B66F 17/00; B66F 19/00; B25B 27/04; B23P 19/025; B23P 19/027; B63C 11/52; F16C 11/045; F16G 15/06; E02F 3/301; E02F 3/382; E02F 9/006; E02F 3/3663; E02F 3/3622; E02F 3/627; E02F 3/3609
USPC ..... 52/632, 848; 59/85, 86; 212/177, 292, 212/299, 300; 414/680, 686; 37/468, 37/403–411
See application file for complete search history.

(56) References Cited

U.S. PATENT DOCUMENTS 6,213,318 B1 * 4/2001 Walker ..... B66C 23/70 212/177
7,134,268 B2 * 11/2006 Siappas ..... B63C 11/52 59/86
7,753,640 B2 * 7/2010 Miyazaki ..... B66C 23/68 212/177
9,815,674 B2 * 11/2017 Foust ..... B66C 23/70
(Continued)

FOREIGN PATENT DOCUMENTS

JP 2009-13730 1/2009

*Primary Examiner* — Robert E Pezzuto
(74) *Attorney, Agent, or Firm* — Oblon, McClelland, Maier & Neustadt, L.L.P.

(57) ABSTRACT

Components of a jig are suppressed from coming into contact with a pin hole when a coupling pin is removed from the pin hole, and a length of the jig in a coupling pin axial direction is held down. A coupling pin attaching/detaching apparatus (a coupling pin extracting apparatus) includes a cylinder and a connection member. The cylinder is arranged outside a coupling pin in a radial direction of the coupling pin and is extensible. The connection member is connected to the coupling pin and the cylinder. Extension of the cylinder causes the coupling pin to be extracted from a pin hole via the connection member.

11 Claims, 8 Drawing Sheets

(56) References Cited

U.S. PATENT DOCUMENTS

| | | | | |
|---|---|---|---|---|
| 2009/0139948 | A1* | 6/2009 | Holly | B66C 23/70 212/292 |
| 2010/0226710 | A1* | 9/2010 | Yamasaki | E02F 3/301 403/81 |
| 2014/0231374 | A1* | 8/2014 | Foust | B66C 23/70 212/347 |

* cited by examiner

COUPLING PIN EXTRACTING APPARATUS AND WORKING MACHINE PROVIDED WITH SAME

TECHNICAL FIELD

The present invention relates to a coupling pin extracting apparatus, and a working machine provided with same.

BACKGROUND ART

For example, Japanese Laid-Open Patent Publication No. 2009-13730 recites a jig for removing a coupling pin which couples coupling bodies from a pin hole (hole portion). According to the technique recited in the literature (see FIG. 8 and FIG. 9), a cylinder and a coupling pin are arranged coaxially, so that extension of the cylinder pushes out the coupling pin from the pin hole.

According to the technique recited in the literature, when a coupling pin is pushed out from a pin hole, components of the jig are arranged inside the pin hole. On this occasion, for example, moving of a coupling body or the like might cause the components of the jig arranged inside the pin hole and the pin hole to come into contact with each other. As a result, the jig might be damaged.

Additionally, since the jig is used for removing a coupling pin from a pin hole, a length of the jig in an axial direction of the coupling pin (a coupling pin axial direction) is expected to matter. For this reason, it is demanded to reduce a length of the jig in the coupling pin axial direction.

SUMMARY OF INVENTION

An object of the present invention is to prevent, in a coupling pin extracting apparatus which extracts a coupling pin from a pin hole and in a working machine provided therewith, a component of a jig from coining into contact with an inner circumference surface of the pin hole when the coupling pin is removed from the pin hole, while reducing a length of the jig in an axial direction of the coupling pin.

A coupling pin extracting apparatus according to the present invention is provided in a working machine. The working machine includes a first coupling body, a second coupling body, and a coupling pin. The first coupling body has a pin hole opened. The second coupling body is arranged adjacent to the first coupling body and has a pin hole opened. The coupling pin is inserted into the pin holes to couple the first coupling body and the second coupling body. The coupling pin extracting apparatus extracts the coupling pin from the pin hole in an axial direction. The coupling pin extracting apparatus includes a frame, at least one cylinder, and a connection member. The frame is attached to the first coupling body to be opposed to the pin hole on a side opposite to the second coupling body in the axial direction of the coupling pin. The frame defines a space portion which accepts the coupling pin extracted from the pin hole. At least one cylinder is arranged to be opposed to the space portion in a direction orthogonal to the axial direction. The cylinder has a cylinder fixed portion which is fixed to the frame, and a cylinder movable portion which is fit on the cylinder fixed portion and is movable relative to the cylinder fixed portion. The connection member connects the coupling pin and the cylinder movable portion with each other such that the coupling pin is extracted from the pin hole in the axial direction and is also guided to the space portion in association with extension operation of the cylinder caused by relative movement of the cylinder movable portion.

Additionally, the working machine according to the present invention includes a main body portion including a slowing frame, a boom attached to the slewing frame in a raisable and lowerable manner, a boom foot pin which couples the slewing frame and the boom to allow the boom to be raised and lowered, and the above coupling pin extracting apparatus. The first coupling body includes the slewing frame, the second coupling body includes the boom, and the coupling pin includes the boom foot pin. The boom foot pin is designed to be inserted into the pin holes opened in the slewing frame and a base end portion of the boom. The coupling pin extracting apparatus extracts the boom foot pin from the pin hole.

DESCRIPTION OF EMBODIMENTS

Figure 1:
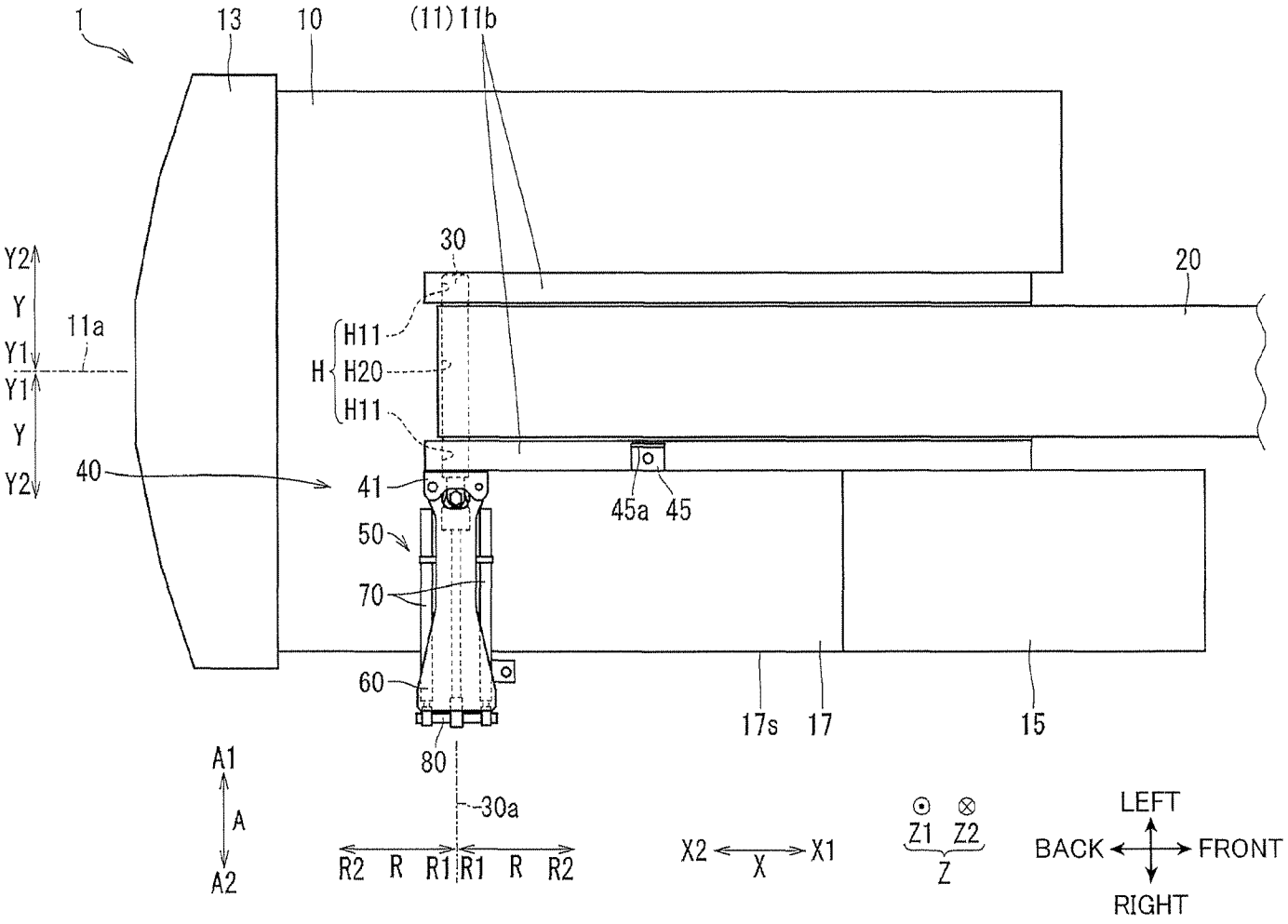
FIG. 1 is a view of a working machine seen from above, which shows a frame in a projected state and a cylinder in a contracted state.

With reference to FIG. 1 to FIG. 8, description will be made of a working machine 1 having a coupling pin attaching/detaching apparatus 40 (a coupling pin extracting apparatus) according to one embodiment of the present invention.

The working machine 1 is a machine which conducts work. The working machine 1 conducts, for example, construction work. The working machine 1 may be a machine which conducts work other than construction work. The working machine 1 is, for example, a crane, or a movable crane. The working machine 1 includes a lower travelling body 5 (see FIG. 2), an upper slewing body 10 (a main body portion), a boom 20 (a second coupling body), a coupling pin 30, and the coupling pin attaching/detaching apparatus 40.

Figure 2:
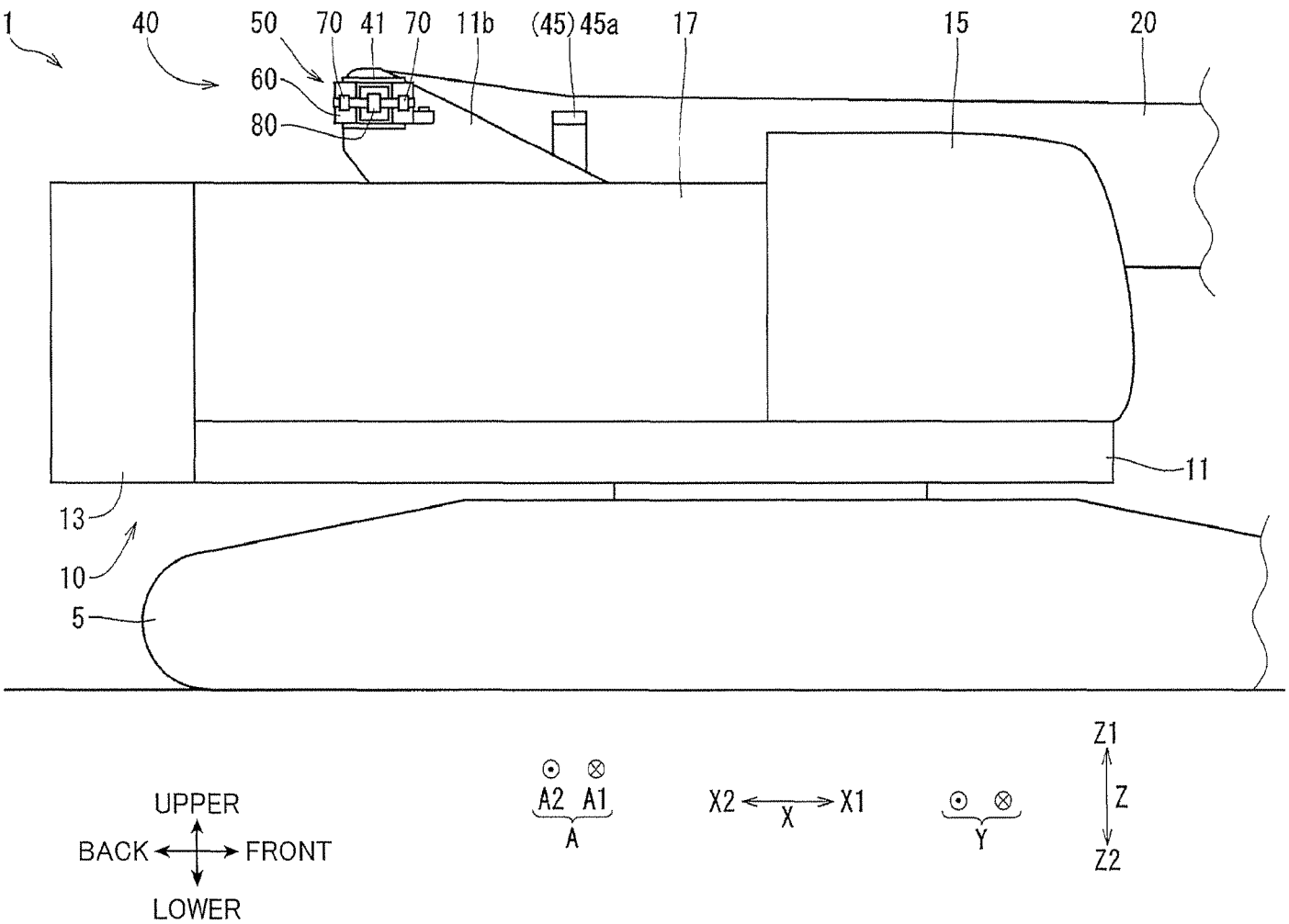
FIG. 2 is a view of the working machine shown in FIG. 1 when seen from the side.

The lower travelling body 5 causes the working machine 1 to travel (FIG. 2). The lower travelling body 5 may include, for example, a crawler not shown, or a wheel not shown.

The upper slewing body 10 (the main body portion) is attached to the lower travelling body 5 so as to be turnable with respect to the lower travelling body 5. The upper slewing body 10 includes a slewing frame 11 (a first coupling body), a counter weight 13, a cab 15, and a guard 17.

The slewing frame 11 (the first coupling body) is a structure to which the counter weight 13, the cab 15 and the like are attached and has a shape elongating along a front-back direction in FIG. 2. The direction in which the slewing frame 11 thus extends is defined as a longitudinal direction of the slewing frame 11. As shown in FIG. 1, a center line of the slewing frame 11, which is a center line extending in the longitudinal direction of the slewing frame 11 (a longitudinal direction of a main body portion of the working machine 1), is defined as a slewing frame center line 11*a*. The slewing frame 11 includes a pair of boom attaching portions 11*b*.

(Direction of Working Machine)

The direction in which the slewing frame center line 11*a* extends is defined as a front-back direction (X) of the working machine 1. In the front-hack direction, a direction heading from the counter weight 13 to the cab 15 is defined as a forward direction (X1) and a reverse direction thereof is defined as a backward direction (X2). A horizontal direction orthogonal to the front-back direction is defined as a lateral direction (Y). In the lateral direction, a direction heading to the slewing frame center line 11*a* is defined as a lateral inward direction (Y1), and a direction going away from the slewing frame center line 11*a* is defined as a lateral outward direction (Y2). As shown in FIG. 2, in an up-down direction (Z) (vertical direction), a direction heading from the lower travelling body 5 to the slewing frame 11 is defined as an upward direction (Z1) and a reverse direction of the upward direction is defined as a downward direction (Z2).

The pair of boom attaching portions 11*b* is a part to which the boom 20 is attached. The pair of boom attaching portions 11*b* protrudes upward from a base plate of the slewing frame 11. An upper surface of each of the boom attaching portions 11*b* has a part slanting in the front-back direction so as to be located lower to the forward direction. As shown in FIG. 1, the pair of boom attaching portions 11*b* is provided at an interval in the lateral direction. The boom attaching portion 11*b* has, for example, a box-shaped structure (a structure having a hollow inside) or may have a plate-shaped structure. Each of the pair of boom attaching portions 11*b* has a circular pin hole H11 (a first hole portion, a hole portion) formed (opened). A direction in which a central axis of the pin hole H11 is parallel to the lateral direction (this is also the case with a pin hole H20). The pin hole H11 is arranged in an upper side and back side end portion of the boom attaching portion 11*b*. "End portion" represents an end and a periphery thereof (the same hereafter).

The counter weight 13 is a weight fixed to a back side part of the slewing frame 11. The cab 15 is a driver's cab in which an operator of the working machine 1 operates the working machine 1. The guard 17 covers an equipment mounted on the slewing frame 11 and includes, for example, an engine guard covering an engine. An end portion of the guard 17 in the lateral outward direction (Y2) is defined as a "vehicle width outermost part 17*s*".

The boom 20 (the second coupling body) is a member which lifts up a hung load via a rope (not shown) and is capable of going up and down with respect to the upper slewing body 10. The boom 20 is attached to the slewing frame 11 via the coupling pin 30 in a raisable and lowerable manner. The boom 20 in a down state extends along the front-back direction. The boom 20 has, for example, a box-shaped structure and is designed to be extensible (a telescopic boom). The boom 20 has the pin hole H20 (a second hole portion, a hole portion) formed (opened). The pin hole H20 is located on the same axis as that of the pin hole H11. The pin hole H20 is arranged in a back side end portion (base end portion) of the boom 20. The back side end portion of the boom 20 is arranged between the pair of boom attaching portions 11*b* so as to be adjacent to the pair of boom attaching portions 11*b*. The pin hole H20 and the pin holes H11 configure a pin hole H.

Figure 3:
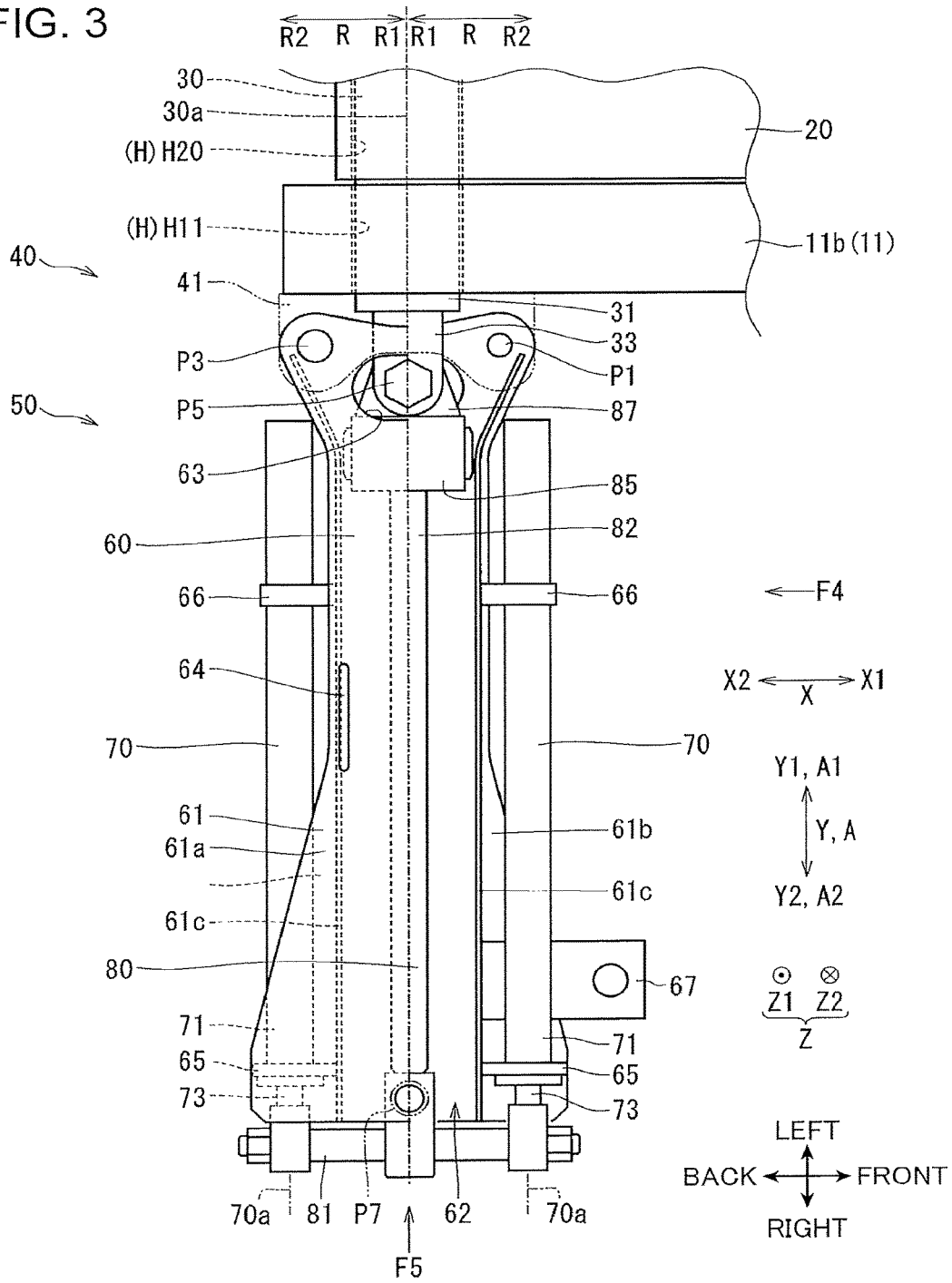
FIG. 3 is a view of a coupling pin extracting apparatus and the like shown in FIG. 1 when seen from above.

The coupling pin 30 is a pin to be attached or detached by the coupling pin attaching/detaching apparatus 40. The coupling pin 30 is put into (attached to, inserted into) the pin hole H (the pin hole H20 and the pin holes H11). The coupling pin 30 couples the slewing frame 11 and the boom 20 so as to allow the boom 20 to be raised and lowered with respect to the slewing frame 11. The coupling pin 30 is referred to also as a boom foot pin. As shown in FIG. 3, the coupling pin 30 includes a generally cylindrical coupling pin main body portion 31, and a coupling pin side bracket 33. A central axis and an extension line thereof of the coupling pin main body portion 31 in the coupling pin 30 are defined as a coupling pin central axis 30*a*. Hereinafter, unless otherwise specified, description will be made of a case of a state where the pin hole H and the coupling pin 30 are coaxially arranged (e.g., a state where the coupling pin 30 is put into the pin hole H, and another state).

(Direction of Coupling Pin)

A direction in which the coupling pin central axis 30*a* extends is defined as a coupling pin axial direction (A) (FIG. 3). In the present embodiment, the coupling pin axial direction is parallel to the lateral direction (Y). One direction in the coupling pin axial direction is defined as a coupling pin insertion direction (A1), and a reverse direction of the coupling pin insertion direction is defined as a coupling pin extraction direction (A2) (FIG. 3). A radial direction of the coupling pin 30 is defined as a coupling pin radial direction (R) (FIG. 3). The coupling pin radial direction is a diameter direction of a virtual circle on a plane orthogonal to the coupling pin central axis 30*a*, the virtual circle being centered around the coupling pin central axis 30*a*. In the coupling pin radial direction, a direction nearing to the coupling pin central axis 30*a* is defined as a coupling pin radial inward direction (R1), and a direction going away from the coupling pin central axis 30*a* is defined as a coupling pin radial outward direction (R2).

The coupling pin side bracket 33 is a member for connecting a connection member 80 (to be noted below) and the coupling pin 30. The coupling pin side bracket 33 is fixed to the coupling pin main body portion 31, and protrudes from an end portion (a right end portion) on a coupling pin extraction direction downstream side of the coupling pin main body portion 31 toward the coupling pin extraction direction (A2) (a right direction).

As shown in FIG. 1, the coupling pin attaching/detaching apparatus 40 is a jig for attaching/detaching (extracting, putting into) the coupling pin 30 to/from the pin hole H. In the present embodiment, the coupling pin attaching/detaching apparatus 40 extracts the coupling pin 30 to the side opposite to the pin hole H20 (to the side of the right pin hole H11 out of the pair of pin holes H11) in the axial direction. The coupling pin attaching/detaching apparatus 40 includes a fixing portion 41 (a jig fixing portion), a fixing side storage portion 45, and an attaching/detaching apparatus 50.

Figure 4:
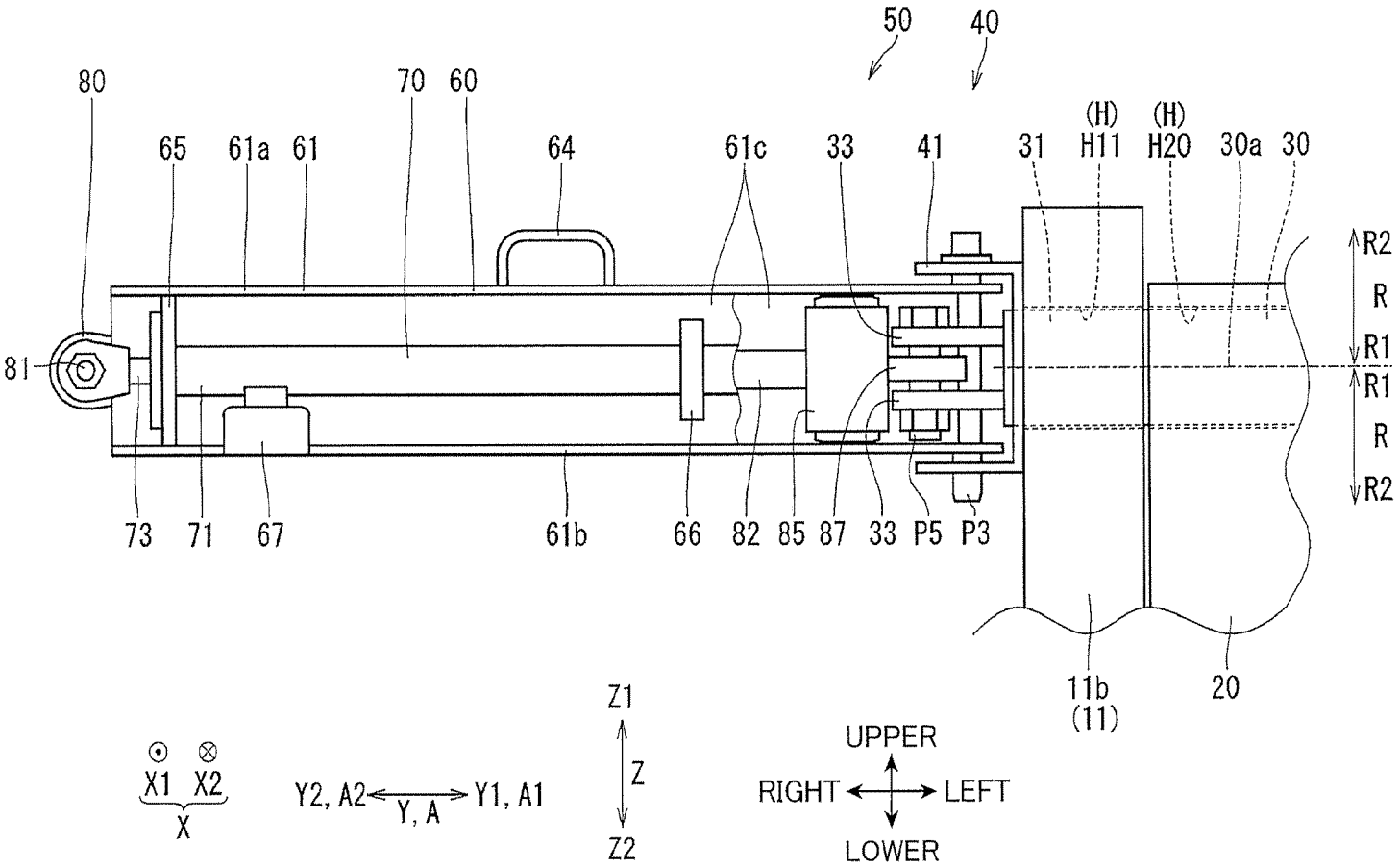
FIG. 4 shows FIG. 3 seen from an arrow of F4.
Figure 7:
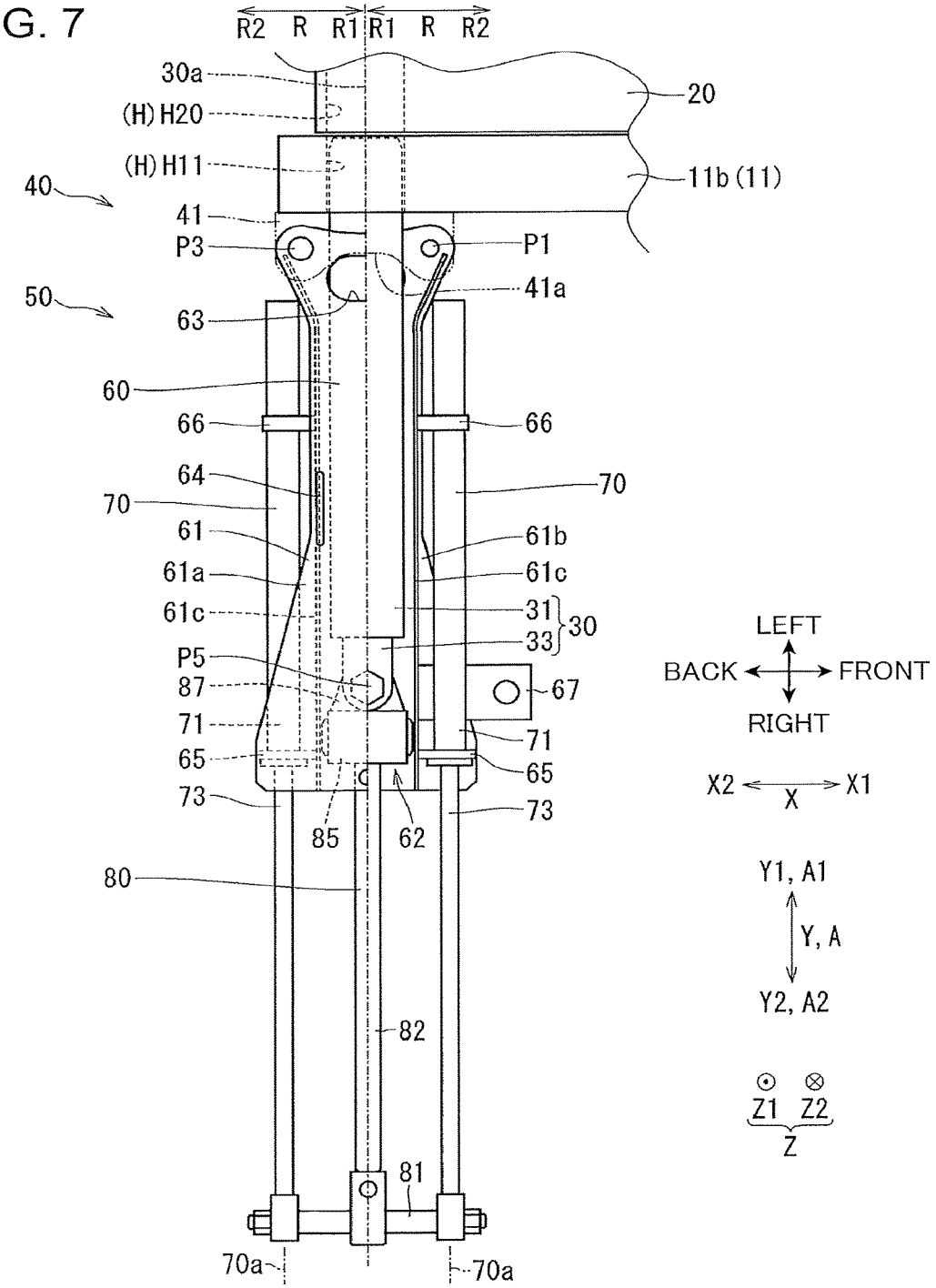
FIG. 7 is a view of the coupling pin extracting apparatus and the like when the cylinders shown in FIG. 3 are in an extended state, which are seen from above.
Figure 8:
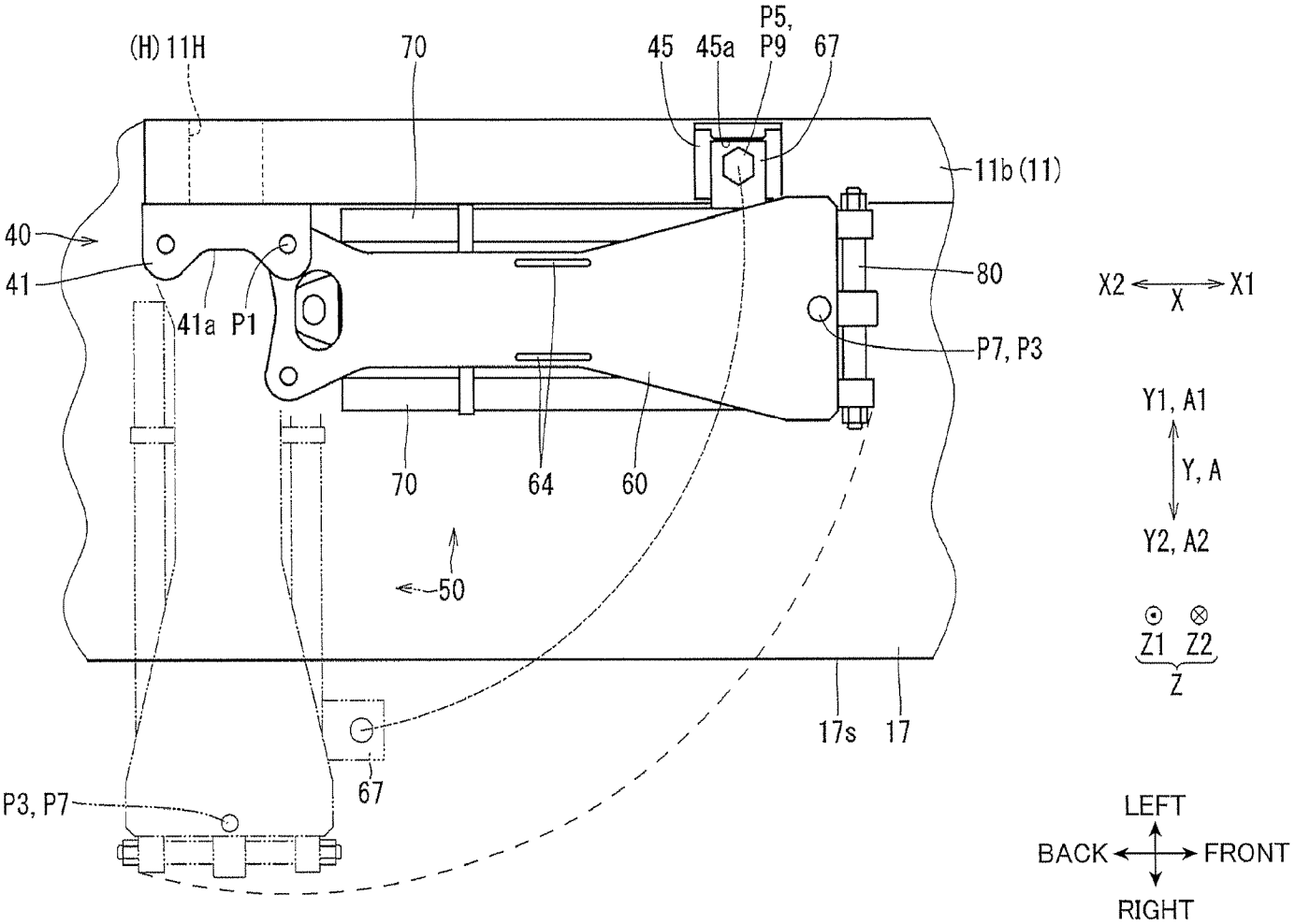
FIG. 8 is a view of the coupling pin extracting apparatus and the like when the frame shown in FIG. 3 is in a stored state, which are seen from above.

A position of the fixing portion 41 with respect to the pin hole H is fixed. The fixing portion 41 is a member (bracket) for supporting and fixing the attaching/detaching apparatus 50. The fixing portion 41 is arranged in the vicinity of the pin hole H without blocking the pin hole H. The fixing portion 41 is fixed to a side surface (a right side surface) of the boom attaching portion 11*b* on the downstream side in the coupling pin extraction direction, and protrudes from the boom attaching portion 11*b* in the coupling pin extraction direction. As shown in FIG. 4, the fixing portion 41 includes two plate-shaped parts which sandwich, for example, the attaching/detaching apparatus 50 from upward and downward. As shown in FIG. 8, the fixing portion 41 includes a depressed portion 41*a* (for the depressed portion 41*a*, see description of a connecting pin attaching/detaching opening portion 63). In FIG. 3 and FIG. 7, illustration of the fixing portion 41 is omitted and an outline of the fixing portion 41 is shown by a chain double-dashed line.

As shown in FIG. 1, a position of the fixing side storage portion 45 with respect to the pin hole H is fixed. The fixing side storage portion 45 is a member (bracket) for fixing a frame 60 in a stored state (see FIG. 8). The fixing side storage portion 45 is arranged outside the pin hole H in the coupling pin radial direction, for example, arranged ahead of the pin hole H. As shown in FIG. 2, the fixing side storage portion 45 is fixed to the boom attaching portion 11*b* and protrudes upward from the upper surface of the boom attaching portion 11*b*. The fixing side storage portion 45 includes a rotation regulating portion 45*a*. The rotation regulating portion 45*a* is a part which regulates rotation of the attaching/detaching apparatus 50 with respect to the fixing portion 41 (see FIG. 8).

The attaching/detaching apparatus 50 (extraction apparatus) is an apparatus which attaches and detaches the coupling pin 30 as shown in FIG. 1. The attaching/detaching apparatus 50 includes the frame 60, at least one cylinder 70, and the connection member 80.

The frame 60 supports the cylinder 70 and the connection member 80. The frame 60 is attached to the slewing frame 11 so as to be opposed to the pin hole H11 on the side opposite to the boom 20 in the axial direction of the coupling pin 30. Additionally, the frame 60 defines a space portion which accepts the coupling pin 30 extracted from the pin hole H11. As shown in FIG. 8, the frame 60 is attached to the fixing portion 41 so as to be rotatable with a support pin P1 as a rotation axis. A direction of the rotation axis of the frame 60 with respect to the fixing portion 41 is a direction orthogonal to the coupling pin axial direction, for example, parallel to the up-down direction. Rotation of the frame 60 with respect to the fixing portion 41 allows the frame 60 (the attaching/detaching apparatus 50) to be changed between a projected state (see FIG. 3 and FIG. 7) and the stored state (see FIG. 8) as will be described in detail later. In the following, unless otherwise specified, the description will be made of a case where the frame 60 is in the projected state. As shown in FIG. 3, the frame 60 includes a frame main body portion 61, a tubular portion 62, the connecting pin attaching/detaching opening portion 63 (see FIG. 7), a grip 64, a cylinder tube fixing portion 65, a cylinder tube supporting portion 66, and a movable side storage portion 67.

The frame main body portion 61 includes, for example, a generally box-shaped structure and includes, for example, a plurality of plate-shaped members. As shown in FIG. 4, the frame main body portion 61 includes an upper plate 61*a* configuring an upper surface of the frame main body portion 61, a lower plate 61*b* configuring a lower surface of the frame main body portion 61, and a pair of vertical plates 61*c*. The pair of vertical plates 61*c* connects the upper plate 61*a* and the lower plate 61*b* and extends in the up-down direction. As shown in FIG. 3, the paired vertical plates 61*c* are disposed at an interval in the front-back direction. A large part of the vertical plate 61*c* extends along the coupling pin axial direction. An end portion of the vertical plate 61*c* on the downstream side in the coupling pin insertion direction slants with respect to the coupling pin axial direction so as to spread outward in the coupling pin radial direction (e.g., the front side or the back side). In FIG. 3 and FIG. 7, a front part of the upper plate 61*a* than the coupling pin central axis 30*a* is omitted from illustration. Additionally, illustration of the grip 64 is similarly omitted.

Figure 5:
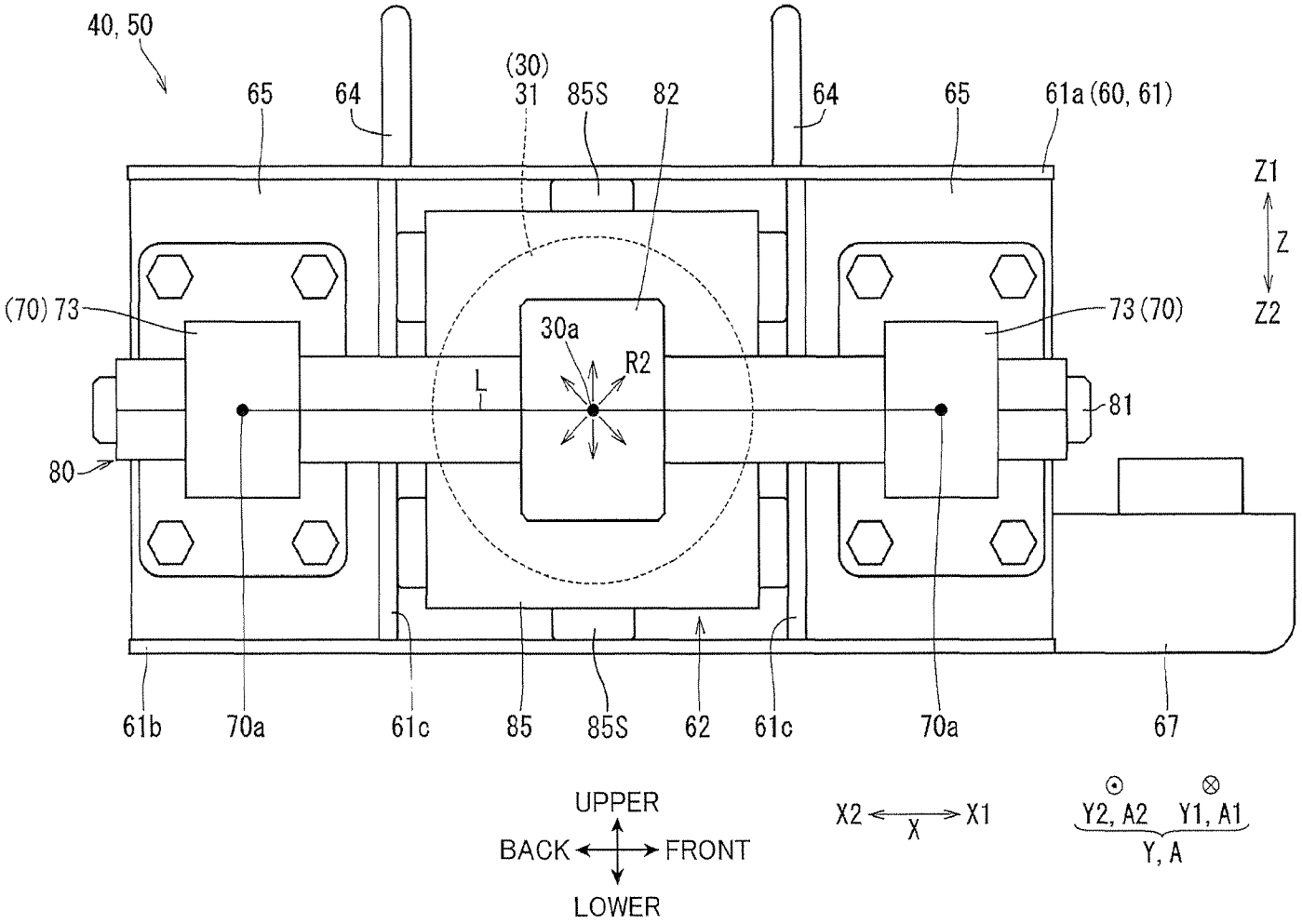
FIG. 5 shows FIG. 3 seen from an arrow of F5.

The tubular portion 62 guides a guide portion 85 to be described later at the time of attaching or detaching the coupling pin 30 as shown in FIG. 3. The tubular portion 62 is arranged (formed) inside the frame main body portion 61. The tubular portion 62 is formed of the upper plate 61*a*, the lower plate 61*b*, and the two vertical plates 61*c*. The tubular portion 62 extends in the axial direction of the coupling pin 30. As shown in FIG. 5, the tubular portion 62 is tubular, for example, square tubular. When viewed along the axial direction of the coupling pin 30, the tubular portion 62 is, for example, square. The tubular portion 62 may be cylindrical or the like.

The connecting pin attaching/detaching opening portion 63 is opened for attaching and detaching a connecting pin P5 as shown in FIG. 3. The connecting pin attaching/detaching opening portion 63 is formed in the frame main body portion 61, and more specifically, formed in each of the upper plate 61*a* and the lower plate 61*b*. The connecting pin attaching/detaching opening portion 63 is formed such that when the cylinder 70 is in a contracted state to be described later, the connecting pin P5 can be inserted into the connecting pin attaching/detaching opening portion 63. The connecting pin attaching/detaching opening portion 63 is a hole, which extends through the upper plate 61*a* and the lower plate 61*b* along the up-down direction. The connecting pin attaching/detaching opening portion 63 may not necessarily be a hole but a depressed part, and may be, for example, a partly depressed part of the end portion of the frame main body portion 61 on the downstream side in the coupling pin insertion direction, the part being depressed toward the coupling pin extraction direction. The fixing portion 41 includes the depressed portion 41*a* as shown in FIG. 8 such that the connecting pin P5 is inserted into the connecting pin attaching/detaching opening portion 63. The depressed portion 41*a* is a partly depressed part of an end portion of the fixing portion 41 on the downstream side in the coupling pin extraction direction, the part being depressed toward the coupling pin insertion direction.

The grip 64 is a part held by a worker at the time of work for rotating the attaching/detaching apparatus 50 with respect to the fixing portion 41. As shown in FIG. 4, the grip 64 protrudes from the frame main body portion 61, for example, protrudes upward from the frame main body portion 61. As shown in FIG. 5, in the present embodiment, the two grips 64 are provided at a front side part and a back side part of the frame main body portion 61, respectively.

The cylinder tube fixing portion 65 is fixed to the frame main body portion 61 as shown in FIG. 3. An end portion of a cylinder tube 71 (described below) on the downstream side in the coupling pin extraction direction is fixed to the cylinder tube fixing portion 65, for example. A force is transmitted to the cylinder tube fixing portion 65 along the axial direction of the coupling pin 30 from the cylinder tube 71.

The cylinder tube supporting portion 66 is fixed to the frame main body portion 61 to support, for example, a front end side part of the cylinder tube 71 in the coupling pin insertion direction with respect to the frame main body portion 61.

The movable side storage portion 67 is a part connected to the fixing side storage portion 45 and is fixed to the fixing side storage portion 45 when the frame 60 is in the stored state as shown in FIG. 8. Hereinafter, description will be made of a case where the frame 60 is in the projected state. As shown in FIG. 3, the movable side storage portion 67 is fixed to the frame main body portion 61, fixed, for example, to the upper plate 61*a*, the lower plate 61*b*, and the vertical plate 61*c*. The movable side storage portion 67 protrudes further ahead than the frame main body portion 61 and protrudes more to the front side than the cylinder 70.

The cylinder 70 is arranged opposed to the space portion in the frame 60 in a direction orthogonal to the axial direction of the coupling pin 30 and is extensible. Extension of the cylinder 70 is controlled by a hydraulic system not shown of the working machine 1. The cylinder 70 is a driving mechanism which attaches and detaches the coupling pin 30. The cylinder 70 is attached to the frame 60. A central axis of the cylinder 70, which is a central axis extending in a longitudinal direction of the cylinder 70, is defined as a cylinder central axis 70*a*. The cylinder 70 is extensible along a direction in which the cylinder central axis 70*a* extends. In the present embodiment, a plurality of, for example, two cylinders 70 are provided. Each of the plurality of cylinders 70 includes the cylinder tube 71 (the cylinder fixed portion) and a cylinder rod 73 (the cylinder movable portion). The cylinder tube 71 is fixed to the frame main body portion 61, and is fixed to each of the cylinder tube fixing portion 65 and the cylinder tube supporting portion 66. The cylinder rod 73 is fit on the cylinder tube 71 so as to be movable with respect to the cylinder tube 71 along the cylinder central axis 70*a* direction.

The cylinder 70 is arranged outside the coupling pin 30 in the coupling pin radial direction. The cylinder central axis 70*a* is arranged outside the coupling pin central axis 30*a* in the coupling pin radial direction. Additionally, the cylinder 70 (at least a part thereof) is arranged outside a locus of the coupling pin 30 in the coupling pin radial direction at the time of attaching or detaching of the coupling pin 30.

Additionally, the cylinder 70 may be arranged only outside the locus of the coupling pin 30 in the coupling pin radial direction at the time of attaching or detaching of the coupling pin 30. For example, the cylinder 70 may be only arranged outside the tubular portion 62 in the coupling pin radial direction.

Additionally, an extension and contraction direction of the cylinder 70 may be parallel to the coupling pin axial direction (may be parallel to the coupling pin central axis 30*a*).

Figure 6:
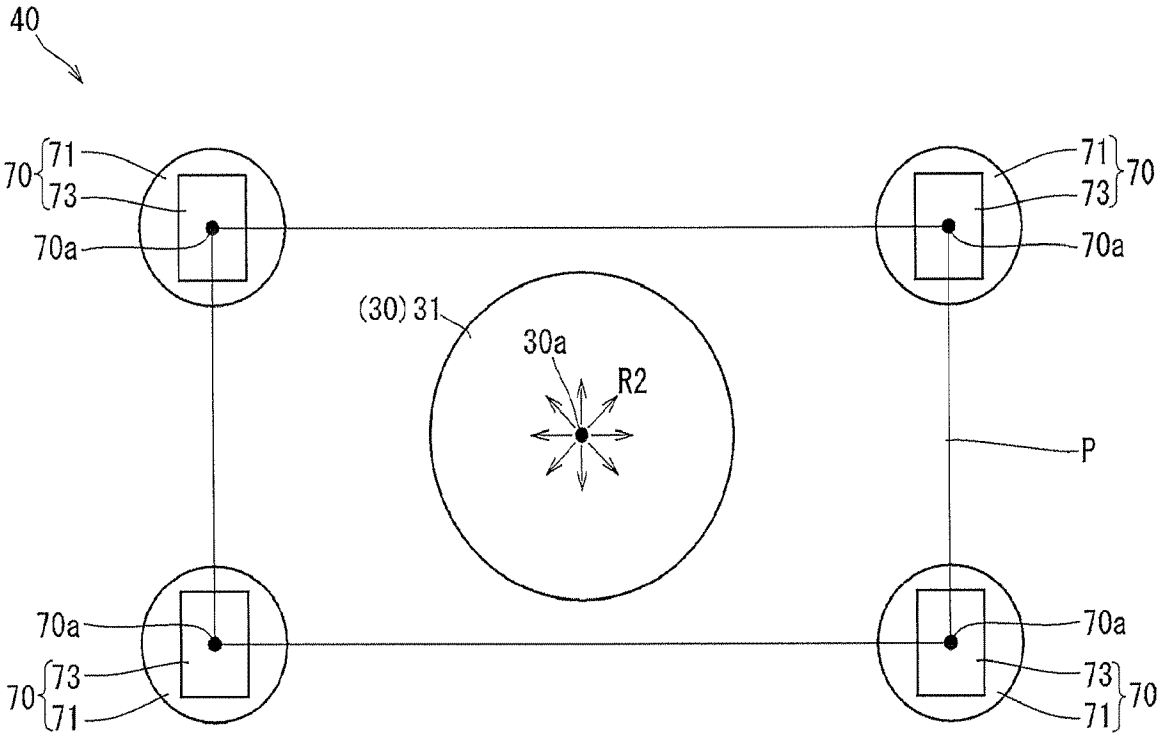
FIG. 6 is a schematic view of the coupling pin extracting apparatus seen from an axial direction of a coupling pin when four cylinders as shown in FIG. 5 are provided.

Hereinafter, as shown in FIG. 5 and FIG. 6, description will be made of an arrangement of the cylinder 70 when viewed along the coupling pin axial direction. As shown in FIG. 5, when the two cylinders 70 are provided, a line segment linking the cylinder central axes 70*a* in front end portions (end portions in the coupling pin extraction direction) of the two cylinders 70 is defined as a line segment L. As shown in FIG. 6, when three or more cylinders 70 are provided, a polygon surrounded by line segments linking the cylinder central axes 70*a* in the front end portions of the cylinders 70 is defined as a polygon P. When the extension and contraction direction of the cylinder 70 is parallel to the coupling pin axial direction, the line segment L shown in FIG. 5 can be said to be a line segment linking the cylinder central axes 70*a*, and the polygon P shown in FIG. 6 can be said to be a polygon surrounded by the line segments linking the cylinder central axes 70*a*.

The plural cylinders 70 are arranged so as to sandwich the coupling pin 30 from the outer side in the coupling pin radial direction. More specifically, in a case where two cylinders 70 are provided, two (a pair of) cylinders 70 are arranged at both sides in the radial direction with the coupling pin 30 sandwiched therebetween when viewed from the axial direction of the coupling pin 30, and at least a part of the coupling pin 30 is arranged on the line segment L as shown in FIG. 5. In other words, the two cylinders 70 are arranged on a straight line in the radial direction passing the central axis of the coupling pin 30 when viewed from the axial direction of the coupling pin 30. Additionally, when three or more cylinders 70 are provided, at least a part of the coupling pin 30 is arranged within the polygon P as shown in FIG. 6.

When two cylinders 70 are provided, at least a part of the coupling pin 30 may be arranged at a middle point of the line segment L as shown in FIG. 5. When three or more cylinders 70 are provided, at least a part of the coupling pin 30 may be arranged at a centroid of the polygon P as shown in FIG. 6.

The plural cylinders 70 are arranged to be rotationally symmetric with respect to the coupling pin central axis 30*a* when viewed along the axial direction of the coupling pin. More specifically, when two cylinders 70 are provided, the cylinder central axes 70*a* in the front end portions of the cylinders 70 (both ends of the line segment L) are arranged to be point symmetric with respect to the coupling pin central axis 30*a* as shown in FIG. 5. When three or more cylinders 70 are provided, the cylinder central axes 70*a* in the front end portions of the cylinders 70 (corners of the polygon P) are arranged to be rotationally symmetric with respect to the coupling pin central axis 30*a* as shown in FIG. 6.

In the following, description will be made of a case where as shown in FIG. 3 and FIG. 7, two cylinders 70 are arranged at an interval from each other in the front-back direction, and an extension and contraction direction of each of the cylinders 70 is parallel to the axial direction of the coupling pin.

The connection member 80 connects the coupling pin 30 and the cylinder 70 with each other such that in association with extension operation of the cylinder 70 due to relative movement of the cylinder rod 73, the coupling pin 30 is extracted at least from the pin hole H20 along the axial direction and is also guided into the space portion in the frame 60 (FIG. 7). In the present embodiment, the connection member 80 is connected to the cylinder rod 73 of the cylinder 70. The connection member 80 includes a first rod 81 (a first member), a second rod 82 (a second member), the guide portion 85, and a connection member side bracket 87.

The first rod 81 is a rod (a generally linear member, a bar-shaped member) connected to each cylinder rod 73 of the plurality of cylinders 70. The first rod 81 is connected to a front end portion of the cylinder rod 73. The first rod 81 extends in the front-back direction.

The second rod 82 is a rod which connects the first rod 81 and the coupling pin 30 with each other. The second rod 82 is connected to the first rod 81 between the front end portions of the plurality of (two) cylinder rods 73. The second rod 82 is connected to the first rod 81 at a center part of the first rod 81 in a longitudinal direction. The second rod 82 is connected to the coupling pin 30 via the connection member side bracket 87. The second rod 82 extends along the coupling pin axial direction and extends in the lateral direction. The second rod 82 (at least a part thereof) is arranged inside the tubular portion 62. Shapes of the first rod 81 (the first member) and the second rod 82 (the second member) are not limited to the above.

The guide portion 85 guides movement of the connection member 80 with respect to the frame 60. The guide portion 85 causes the connection member 80 to move with respect to the frame 60 along the coupling pin axial direction and regulates movement of the connection member 80 with respect to the frame 60 in the coupling pin radial direction. The guide portion 85 is fixed to the second rod 82, for example, to a downstream side part of the second rod 82 in the coupling pin insertion direction (e.g., an end portion).

The guide portion 85 is arranged inside the tubular portion 62 and is in contact with an inner surface of the tubular portion 62. The guide portion 85 is slidable with respect to the tubular portion 62. The guide portion 85 includes a pair of slide members 85S arranged at a part in contact with the inner surface of the tubular portion 62 (see FIG. 5). The pair of slide members 85S is, for example, made of a resin, or, for example, a pad.

The connection member side bracket 87 is a member (bracket) for connecting the connection member 80 and the coupling pin 30. The connection member side bracket 87 is connected (fixed) to the coupling pin side bracket 33 via the connecting pin P5. The connection member side bracket 87 is fixed to the end portion of the second rod 82 on the downstream side in the coupling pin insertion direction.

(Shape of Frame Main Body Portion 61)

A structure of the frame main body portion 61 is set according to arrangement of the cylinder 70 shown in FIG. 3 or the like. The frame main body portion 61 is configured to be able to ensure a strength for supporting a force transmitted from the cylinder 70 (a force in the extension and contraction direction of the cylinder 70) and to be light-weighted. Specifically, in the frame main body portion 61, a width, in the front-back direction (a width in the coupling pin radial direction) of the vicinity of the cylinder tube fixing portion 65, is larger than a width, in the front-back direction, of a generally center part or the like of the frame main body portion 61 in the coupling pin axial direction. The width of the frame main body portion 61 in the front-back direction gradually increases from the generally center part of the frame main body portion 61 in the coupling pin axial direction toward the downstream side in the coupling pin extraction direction until reaching the vicinity of the cylinder tube fixing portion 65. The upper plate 61*a* and the lower plate 61*b* of the frame main body portion 61 are arranged so as to sandwich the cylinder tube fixing portion 65 from upward and downward.

In the frame main body portion 61, a width, in the front-back direction, of an end portion on the downstream side in the coupling pin insertion direction, is larger than the width, in the front-back direction, of the generally center part of the frame main body portion 61 in the coupling pin axial direction. This ensures an interval between the support pin P1 and a fixing pin P3 in the front-back direction.

In the frame main body portion 61, compared with a width, in the front-back direction, of each of a downstream side part in the coupling pin insertion direction and a downstream side part in the coupling pin extraction direction, the width, in the front-back direction, of the generally center part of the frame main body portion 61 in the coupling pin axial direction, is small. This configuration enables the frame main body portion 61 to be light-weighted more than the frame main body portion 61 having a rectangular solid shape, for example.

(Details of Each Pin)

The support pin P1 is a pin which connects the fixing portion 41 and the frame 60 so as to allow the frame 60 to be rotatable with respect to the fixing portion 41. The support pin P1 is put into a hole portion not shown which is opened, for example, in a front side part of each of the fixing portion 41 and the frame 60. In particular, the support pin P1 is put into a hole portion opened in an end portion of the frame 60 on the downstream side in the coupling pin insertion direction. A direction of a central axis of the support pin P1 is parallel to the up-down direction. That the direction of the central axis is parallel to the up-down direction is also the case with the fixing pin P3, the connecting pin P5, a connection member fixing pin P7, and a storage pin P9 (in another embodiment, a central axis of each pin may not necessarily be parallel to the up-down direction).

The fixing pin P3 is a pin for fixing the frame 60 to the fixing portion 41. The fixing pin P3 is detachably attached with respect to the fixing portion 41 and the frame 60. The fixing pin P3 is put into a hole portion not shown which is opened, for example, in a back side part of each of the fixing portion 41 and the frame 60. In particular, the fixing pin P3 is put into the end portion of the frame 60 on the downstream side in the coupling pin insertion direction. The frame 60 is fixed to the slewing frame 11 via the fixing portion 41 by the fixing pin P3.

As shown in FIG. 4, the connecting pin P5 is a pin (boom foot coupling pin) which connects the coupling pin 30 and the connection member 80, and a pin which connects the coupling pin side bracket 33 and the connection member side bracket 87. The connecting pin P5 is, for example, a bolt or the like.

As shown in FIG. 8, the connection member fixing pin P7 is a pin which fixes the connection member 80 to the frame 60. The connection member fixing pin P7 regulates extension and contraction of the cylinder 70 and fixes the cylinder 70 in the contracted state. The connection member fixing pin P7 is detachably attached with respect to the frame 60 and the connection member 80. As shown in FIG. 3, the connection member fixing pin P7 is put into the hole portion not shown which is opened, for example, in an end portion of the frame 60 on the downstream side in the coupling pin extraction direction. Additionally, the connection member fixing pin P7 is put into a hole portion not shown which is opened in an end portion of the connection member 80 on the downstream side (e.g., the second rod 82) in the coupling pin extraction direction.

The storage pin P9 is a pin for fixing the frame 60 in the stored state as shown in FIG. 8. The storage pin P9 is detachably attached with respect to the fixing side storage portion 45 and the movable side storage portion 67.

(Operation of Coupling Pin Attaching/Detaching Apparatus 40)

The coupling pin attaching/detaching apparatus 40 operates in a manner below. The frame 60 is designed to have a state changeable (position changeable) between the projected state (see FIG. 3 and FIG. 7) and the stored state (see FIG. 8).

(Projected State)

As shown in FIG. 3 and FIG. 7, the projected state is a state of the frame 60 when the attaching/detaching apparatus 50 attaches and detaches the coupling pin 30. The frame 60 in the projected state shown in FIG. 3 is arranged to protrude from the pin hole H (the boom attaching portion 11*b* of the slewing frame 11) in the coupling pin axial direction and projects from the pin hole H outward in the lateral direction. At this time, the frame 60 is fixed to the slewing frame 11 via the fixing portion 41, so that a position of the frame 60 with respect to the pin hole H is fixed. At this time, the fixing pin P3 is put into the hole portion not shown which is opened in each of the fixing portion 41 and the frame 60, thereby fixing the frame 60 to the fixing portion 41.

(Coupling Pin Extraction Operation)

When the coupling pin 30 is extracted (at the time of extraction) in the state shown in FIG. 3, the coupling pin attaching/detaching apparatus 40 operates in the following manner. Extension of the cylinder 70 causes the coupling pin 30 to be extracted from the pin hole H via the connection member 80 (moved along the coupling pin extraction direction). Details of this operation are as follows. The cylinder rod 73 of each of the two cylinders 70 is moved with respect to the cylinder tube 71 in the coupling pin extraction direction. As a result, the cylinder rod 73 causes the connection member 80 to move in the coupling pin extraction direction. At this time, the guide portion 85 slides on the inner surface of the tubular portion 62 to move in the coupling pin extraction direction, thereby guiding movement of the second rod 82. The second rod 82 causes the coupling pin 30 to move in the coupling pin extraction direction via the connection member side bracket 87. As shown in FIG. 7, when the cylinder 70 extends to a predetermined length, the coupling pin 30 is extracted from the pin hole H20 of the boom 20. As a result, the boom 20 is brought into a state of being separable from the slewing frame 11. In this state, the cylinder 70 finishes extending. At this time, the cylinder 70 enters an extended state (e.g., a most extended).

When the cylinder 70 is in the extended state, at least a part of the coupling pin 30 is arranged on the side more downstream in the coupling pin extraction direction than an end portion of the cylinder 70 on the downstream side in the coupling pin insertion direction. At this time, at least a part of the coupling pin 30 is sandwiched between the two cylinders 70 in the front-back direction. At this time, a large part of the coupling pin 30 is arranged inside the tubular portion 62.

(Coupling Pin Insertion Operation)

When the coupling pin 30 is put into the hole in the state shown in FIG. 7 (at the time of insertion), the coupling pin attaching/detaching apparatus 40 conducts reverse operation to that conducted at the time of extraction. The operation is outlined as follows. Contraction of the cylinder 70 causes the coupling pin 30 to be put into the pin hole H via the connection member 80 (moved in the coupling pin insertion direction). As a result, the coupling pin 30 is put into the pin hole H11 of the slewing frame 11 (the boom attaching portion 11*b*) and the pin hole H20 of the boom 20 as shown in FIG. 3. As a result, the slewing frame 11 and the boom 20 are connected. In this state, contraction of the cylinder 70 ends. At this time, the cylinder 70 enters the contracted state (e.g., a most contracted state).

(Stored State)

As shown in FIG. 8, the stored state of the attaching/detaching apparatus 50 is a state where attaching/detaching operation of the coupling pin 30 is not executed and a state where the frame 60 is stored. A longitudinal direction of the frame 60 in the stored state is a direction different from the coupling pin axial direction, and is specifically a direction orthogonal to the coupling pin axial direction and is parallel to the front-back direction.

Operation of the coupling pin attaching/detaching apparatus 40 is as follows when the state of the frame 60 changes from the projected state (see FIG. 3) to the stored state (see FIG. 8). In the following, description will be made following procedures of work for changing the projected state to the stored state (procedures may be appropriately changed). The connecting pin P5 shown in FIG. 3 is removed from the coupling pin side bracket 33 and the connection member side bracket 87. Next, the coupling pin 30 is removed from the connection member 80. Next, the cylinder 70 is brought into the contracted state. Next, the connection member fixing pin P7 is put into the hole portions of the frame 60 and the connection member 80. As a result, the frame 60 and the connection member 80 are fixed, so that the cylinder 70 is fixed in the contracted state. The connection member fixing pin P7 is used also as the fixing pin P3 (in another embodiment, the connection member fixing pin P7 may not necessarily be used also as the fixing pin P3).

The fixing pin P3 is removed from the fixing portion 41 and the frame 60. Next, as shown in FIG. 8, the attaching/detaching apparatus 50 is rotated with respect to the fixing portion 41, with the support pin P1 as a center of rotation. At this time, the attaching/detaching apparatus 50 rotates such that an end portion of the attaching/detaching apparatus 50 on the downstream side in the coupling pin extraction direction moves forward. When the attaching/detaching apparatus 50 rotates, the movable side storage portion 67 comes into contact with the rotation regulating portion 45*a* of the fixing side storage portion 45. As a result, rotation of the attaching/detaching apparatus 50 is regulated. Next, the storage pin P9 is put into hole portions of the fixing side storage portion 45 and the movable side storage portion 67, so that the movable side storage portion 67 and the fixing side storage portion 45 are fixed. As a result, the frame 60 is fixed with respect to the slewing frame 11 (to the pin hole H). This state of the frame 60 is the stored state. The storage pin P9 is used also as the connecting pin P5 (in another embodiment, the storage pin P9 may not necessarily be used also as the connecting pin P5).

As described in the foregoing, in the present embodiment, the frame 60 is attached to the slewing frame 11 to be rotatable around the rotation axis extending in a direction orthogonal to the axial direction of the coupling pin 30, so that the frame 60 is allowed to change a posture thereof along with rotation around the rotation axis between a projected posture of projecting from the slewing frame 11 in the axial direction by a predetermined amount of projection, the projected posture being a posture where the space portion in the frame 60 accepts the coupling pin 30, and a stored posture of projecting from the slewing frame 11 in the axial direction by an amount of projection smaller than that of the projected posture.

(Problem of Structure for Pushing out Coupling Pin)

Consideration will be given to another jig having a structure in which with the cylinder 70 and the coupling pin 30 coaxially arranged, extension of the cylinder 70 causes the cylinder 70 to push out the coupling pin 30 from the pin hole H (as Comparative Example 1). In this jig of the Comparative Example 1, when the coupling pin 30 is pushed out from the pin hole H, the cylinder rod 73 remains in the pin hole H (boss). Therefore, for example, when the upper slewing body 10 or the boom 20 moves, the cylinder rod 73 might come into contact with the pin hole H to damage the cylinder rod 73.

(Problem of Structure with Coaxially Arranged Cylinder and Coupling Pin)

Additionally, consideration will be given to another jig having a structure in which with the cylinder 70 and the coupling pin 30 coaxially arranged, contraction of the cylinder 70 causes the cylinder 70 to extract the coupling pin 30 from the pin hole H (as Comparative Example 2). The structure of this Comparative Example 2 mitigates the above problem of Comparative Example 1. However, there remains a need of ensuring a "draught" of the coupling pin 30. More specifically, since in Comparative Example 2, the cylinder 70 is coaxially arranged with the coupling pin 30, the cylinder 70 in the contracted state should be arranged on the side more downstream in the coupling pin extraction direction than the extracted coupling pin 30. Therefore, as compared with the present embodiment, a length of a jig (a length of a configuration, an entire length) in the coupling pin axial direction might be increased.

(Problem of Protrusion from Vehicle Width Outermost Part 17*s*)

When the jig is long in the lateral direction as in Comparative Example 2, the jig might largely protrude from the vehicle width outermost part 17*s* (see FIG. 1) in the lateral outward direction (more largely than in the present embodiment). Therefore, the jig might become a hindrance during working of the working machine 1 (in particular, during working in a narrow space) or during transportation of the working machine 1. By way of prevention, the attaching/detaching apparatus 50 may be attached to the upper slewing body 10 during assembly and disassembly of the working machine 1 (at the time of attachment and detachment of the coupling pin 30) and the attaching/detaching apparatus 50 may be removed from the upper slewing body 10 during working and transportation of the working machine 1. However, attachment or detachment of the attaching/detaching apparatus 50 to or from the upper slewing body 10 takes time for working. Additionally, at the time of transportation of the upper slowing body 10, the attaching/detaching apparatus 50 should be transported separately from the upper slewing body 10. Therefore, it takes time for working for transporting the attaching/detaching apparatus 50. Additionally, a transportation apparatus is required for transporting the attaching/detaching apparatus 50. Ensuring a space for using the transportation apparatus therefore might make a working space for the working machine 1 be narrow. By contrast, the coupling pin attaching/detaching apparatus 40 of the present embodiment enables mitigation of the above problems as described in the following. The coupling pin attaching/detaching apparatus 40 of the present embodiment may enable only a part of the above-described problems to be mitigated.

Effects obtained by the coupling pin attaching/detaching apparatus 40 shown in FIG. 1 are as follows. The coupling pin attaching/detaching apparatus 40 is provided in the working machine 1. The working machine 1 includes the slewing frame 11, the boom 20, and the coupling pin 30. The coupling pin 30 is inserted into the pin hole H of the slewing frame 11 and the boom 20 to couple the slewing frame 11 and the boom 20. The coupling pin attaching/detaching apparatus 40 includes the cylinder 70 and the connection member 80.

The cylinder 70 is arranged outside the coupling pin 30 in the radial direction of the coupling pin and is extensible. The connection member 80 is connected to the coupling pin 30 and the cylinder 70. Extension of the cylinder 70 causes the coupling pin 30 to be extracted from the pin hole H via the connection member 80.

In such a configuration, when the coupling pin 30 is extracted, it is unnecessary to arrange (leave) the components of the coupling pin attaching/detaching apparatus 40 (e.g., the cylinder rod 73, the second rod 82 and the like shown in FIG. 3) inside the pin hole H. Thus, when the coupling pin 30 shown in FIG. 1 is removed from the pin hole H, the components of the coupling pin attaching/detaching apparatus 40 are suppressed from coming into contact with the pin hole H. As a result, the coupling pin attaching/detaching apparatus 40 is suppressed from being damaged.

Additionally, as shown in FIG. 7, since the cylinder 70 is arranged outside the coupling pin 30 in the radial direction of the coupling pin, at least a part of the cylinder 70 can be arranged on the more downstream side in the coupling pin insertion direction than an end portion of the extracted coupling pin 30 on the downstream side in the coupling pin extraction direction. Therefore, compared with a case where such arrangement is not allowed (e.g., in the above Comparative Example 2 or the like), the length of the coupling pin attaching/detaching apparatus 40 in the coupling pin axial direction shown in FIG. 3 can be held down.

The "length of the coupling pin attaching/detaching apparatus 40 in the coupling pin axial direction" is a length in the coupling pin axial direction from the pin hole H to an end portion of the coupling pin attaching/detaching apparatus 40 on the downstream side in the coupling pin extraction direction. Additionally, this length is a length when the cylinder 70 is in the contracted state. Additionally, this length is a length when the frame 60 is in the projected state in the present embodiment.

Additionally, in the present embodiment, a plurality of cylinders 70 is provided. Therefore, compared with a case where only one cylinder 70 is provided, each cylinder 70 can be reduced in size.

Additionally, in the present embodiment, as shown in FIG. 5, the plural cylinders 70 are arranged so as to sandwich the coupling pin 30 from the outer side in the coupling pin radial direction when viewed along the coupling pin axial direction. Therefore, a bending force generated in the connection member 80 can be suppressed. As a result, the connection member 80 can be reduced in size and weight to realize a simple configuration.

The plurality of cylinders 70 is arranged to be rotationally symmetric with respect to the coupling pin central axis 30*a* when viewed along the coupling pin axial direction. This enables further suppression of the bending force generated in the connection member 80. As a result, the connection member 80 can be further reduced in size and weight to realize a simple configuration.

Additionally, in the present embodiment, the connection member 80 includes the first rod 81 connected to each of the plurality of cylinders 70, and the second rod 82 connected to the first rod 81 and the coupling pin 30 as shown in FIG. 3. Thus, the connection member 80 can be simply configured.

Further, in the present embodiment, a direction of extension and contraction of the cylinder 70 is a direction parallel to the coupling pin central axis 30*a*. Thus, it is not necessary to provide a mechanism for converting operation of the cylinder 70 in the extension and contraction direction to operation in the coupling pin axial direction. Thus, the connection member 80 can be reduced in size and weight to realize a simple configuration.

Further, in the present embodiment, a direction in which the coupling pin central axis 30*a* extends (the coupling pin axial direction) is a direction orthogonal to a longitudinal direction of the upper slewing body 10 of the working machine 1 and a direction extending in the horizontal direction (the lateral direction) as shown in FIG. 1. In the present embodiment, the cylinder 70 is arranged outside the coupling pin 30 in the radial direction of the coupling pin. Thus, the length of the coupling pin attaching/detaching apparatus 40 in the coupling pin axial direction is reduced. Further, since as described above, the coupling pin axial direction extends along the direction orthogonal to the longitudinal direction of the upper slewing body 10, the length of the coupling pin attaching/detaching apparatus 40 in the lateral direction is reduced. Therefore, for example, an amount of protrusion (an amount of projection) of the coupling pin attaching/detaching apparatus 40 from an end portion of the upper slewing body 10 (the vehicle width outermost part 17*s*) in the lateral outward direction is suppressed, or alternatively, the amount of protrusion can be eliminated. As a result, during working and transportation of the working machine 1, the part of the coupling pin attaching/detaching apparatus 40 protruding from the vehicle width outermost part 17*s* can be suppressed from becoming a hindrance.

Additionally, in the present embodiment, the coupling pin attaching/detaching apparatus 40 includes the fixing portion 41 and the frame 60 as shown in FIG. 8. A position of the fixing portion 41 is fixed with respect to the pin hole H. Additionally, the frame 60 is attached to the fixing portion 41 so as to be rotatable with a direction orthogonal to the coupling pin axial direction as a rotation axis, thereby supporting the cylinder 70 and the connection member 80. In this case, rotation of the frame 60 with respect to the fixing portion 41 enables the coupling pin attaching/detaching apparatus 40 to have a variable length in the coupling pin axial direction. For example, rotation of the frame 60 with respect to the fixing portion 41 enables reduction in the length of the coupling pin attaching/detaching apparatus 40 in the coupling pin axial direction to allow storage of the coupling pin attaching/detaching apparatus 40.

Further, in the present embodiment, the coupling pin attaching/detaching apparatus 40 includes the fixing pin P3 as shown in FIG. 3. The fixing pin P3 is attachable to or detachable from the fixing portion 41 and the frame 60, and enables the frame 60 to be fixed to the fixing portion 41. In this case, attachment/detachment of the fixing pin P3 enables switching with ease between a state where the frame 60 is fixed to the fixing portion 41 and a state where the frame 60 is rotatable with respect to the fixing portion 41. As a result, switching can be easily made between a state of the frame 60 (the projected state) when the coupling pin 30 is attached/detached, and a state, as shown in FIG. 8, where the frame 60 is stored (the stored state) without attachment/detachment of the coupling pin 30. For example, the switching is possible without using a tool or a jig.

Further, in the present embodiment, the direction in which the coupling pin central axis 30*a* extends is parallel to the horizontal direction (the lateral direction) orthogonal to the longitudinal direction of the upper slewing body 10 of the working machine 1 as shown in FIG. 1. As described above, the frame 60 is attached to the fixing portion 41 so as to be rotatable with the direction orthogonal to the coupling pin axial direction as a rotation axis, thereby supporting the cylinder 70 and the connection member 80. In this case, as shown in FIG. 8, rotation of the frame 60 with respect to the fixing portion 41 enables the coupling pin attaching/detaching apparatus 40 to have a variable length in the coupling pin axial direction. Further, since the direction in which the coupling pin central axis 30*a* extends is the horizontal direction orthogonal to the longitudinal direction of the upper slowing body 10 of the working machine 1, the above rotation of the frame 60 enables the coupling pin attaching/detaching apparatus 40 to have a variable length in the lateral direction. For example, the above rotation of the frame 60 enables reduction in the length of the coupling pin attaching/detaching apparatus 40 in the lateral direction.

Specifically, for example, there is a case where when the frame 60 is in the projected state, the coupling pin attaching/detaching apparatus 40 protrudes from the vehicle width outermost part 17*s* in the lateral outward direction as shown in FIG. 1. Even in this case, rotation of the frame 60 with respect to the fixing portion 41 enables arrangement of the coupling pin attaching/detaching apparatus 40 only inside the vehicle width outermost part 17*s* in the lateral direction. It is therefore possible to mitigate the "Problem of Protrusion from Vehicle Width Direction Outermost Part 17*s*".

Further, in the present embodiment, the first coupling body is the slewing frame 11 configuring the main body portion (the upper slewing body 10) of the working machine 1. The second coupling body is the boom 20 attached to the slewing frame 11 via the coupling pin 30 in a raisable and lowerable manner. The coupling pin 30 is a boom foot pin inserted into the pin hole H20 formed at the base end portion (the end portion on the back side) of the boom 20.

In this case, the coupling pin attaching/detaching apparatus 40 is used for extracting the boom foot pin of a crane. The boom foot pin is larger than another pin (e.g., the support pin P1 in FIG. 3 or the like), so that the pin cannot be extracted manually. Therefore, use of the coupling pin attaching/detaching apparatus 40 easily facilitates extraction of the coupling pin 30 as the boom foot pin.

As described in the foregoing, in the present embodiment, the working machine 1 includes the upper slewing body 10 including the stewing frame 11, the boom 20 attached to the slewing frame 11 to be able to be raised and lowered, the boom foot pin which couples the slewing frame 11 and the boom 20 so as to enable the boom 20 to be raised and lowered, and the coupling pin attaching/detaching apparatus 40. The first coupling body according to the present invention includes the slewing frame 11, the second coupling body includes the boom 20, and the coupling pin includes the boom foot pin. The boom foot pin is designed to be inserted into the pin hole H11 opened in the slewing frame 11 and into the pin hole H20 opened in the base end portion of the boom 20. The coupling pin attaching/detaching apparatus 40 extracts the boom foot pin at least from the pin hole H20.

Modified Embodiment

Although the members (the first coupling body and the second coupling body) coupled by the coupling pin 30 in the above embodiment are the slewing frame 11 and the boom 20, either one or both of these may be changed. The coupling pin 30, which is the boom foot pin in the above embodiment, may be another pin. The coupling pin 30, which is arranged in a back side part of the boom attaching portion 11*b* in the above embodiment, may be arranged in, for example, an end portion on the front side of the slewing frame 11. The boom 20, which is an extensible boom in the above embodiment, may be a latticed boom.

The coupling pin attaching/detaching apparatus 40 is used for extracting the coupling pin 30, and may not necessarily be used for putting the coupling pin 30 into the pin hole H.

The arrangement and the operation directions in the above embodiment may be changed. For example, the coupling pin axial direction, which is the lateral direction in the above embodiment, may be the front-back direction or the up-down direction, or a direction slanting to these directions. For example, although when the working machine 1 is viewed from the back side toward the front side, the coupling pin attaching/detaching apparatus 40 is arranged further on the right side than the boom attaching portion 11*b* in FIG. 1, the coupling pin attaching/detaching apparatus 40 may be arranged further on the left side than the boom attaching portion 11*b*. For example, although a direction in which the rotation axis of the attaching/detaching apparatus 50 with respect to the fixing portion 41 extends is the up-down direction in the above embodiment, the direction may be the horizontal direction or a direction slanting to these directions. Although the direction of the rotation for changing the attaching/detaching apparatus 50 from the projected state to the stored state is counterclockwise when viewed from above in the example shown in FIG. 8, the direction may be clockwise. Although the extension and contraction direction of the cylinder 70 shown in FIG. 7 is parallel to the coupling pin axial direction in the above embodiment, the direction may slant to the coupling pin axial direction or may be orthogonal to the coupling pin axial direction. When the extension and contraction direction of the cylinder 70 and the coupling pin axial direction are different from each other (cross with each other), a mechanism is preferably provided which converts movement of the cylinder 70 in the extension and contraction direction into movement in the coupling pin axial direction.

A part of the components of the above embodiment may not necessarily be provided. For example, such a configuration as shown in FIG. 8, in which the frame 60 is rotatable with respect to the fixing portion 41, may not necessarily be provided. For example, the position of the frame 60 may be constantly fixed with respect to the pin hole H.

Fixing or connection may be made directly or indirectly. For example, the frame 60, which is fixed to the slewing frame 11 via the fixing portion 41 in the above embodiment, may be directly fixed to the slewing frame 11. For example, the fixing portion 41, which is separate from the slewing frame 11 in the example shown in FIG. 4, may be configured integrally with the slewing frame 11.

The number of components in the above embodiment may be changed. For example, although two cylinders 70 are provided in the present embodiment and four cylinders 70 are provided in FIG. 6, only one, or three, or five or more cylinders may be provided. Of the cylinder tube 71 and the cylinder rod 73 shown in FIG. 7, the member fixed to the frame 60, which is the cylinder tube 71 in the above embodiment, may be the cylinder rod 73.

The shapes of the components in the above embodiment may be changed. For example, the connection member 80 may not necessarily be provided with such rods as the first rod 81 and the second rod 82.

A detachable pin such as the fixing pin P3 may not necessarily be attached or detached manually, but may be attached or detached using a tool or a jig.

This application is based on Japanese Patent application No. 2016-121131 filed in Japan Patent Office on Jun. 17, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A coupling pin extracting apparatus provided in a working machine including a first coupling body and a second coupling body each having a pin hole opened therein, the second coupling body being arranged adjacent to the first coupling body, and a coupling pin inserted into the pin holes to couple the first coupling body and the second coupling body, the coupling pin extracting apparatus extracting the coupling pin from the pin hole to an extracted position in an axial direction, the coupling pin extracting apparatus comprising:

a frame attached to the first coupling body to be opposed to the pin hole on a side opposite to the second coupling body in the axial direction of the coupling pin, the frame defining a space portion which accepts the coupling pin extracted from the pin hole;

at least one cylinder extensible and arranged to be opposed to the coupling pin at the extracted position in a radial direction orthogonal to the axial direction, the cylinder including a cylinder fixed portion which is fixed to the frame, and a cylinder movable portion which is fit on the cylinder fixed portion and is movable relative to the cylinder fixed portion, and the cylinder having a specific cylinder central axis extending radially outside a coupling pin central axis of the coupling pin; and a connection member which connects the coupling pin and the cylinder movable portion with each other in the radial direction and operable to extract the coupling pin from the pin hole along the axial direction while guiding the coupling pin to the space portion in association with extension operation of the cylinder caused by relative movement of the cylinder movable portion.

2. The coupling pin extracting apparatus according to claim 1, wherein the at least one cylinder comprises a plurality of cylinders.

3. The coupling pin extracting apparatus according to claim 2, wherein the connection member includes:

a first member which connects the cylinder movable portions of the plurality of cylinders with each other; and a second member which connects the first member and the coupling pin.

4. The coupling pin extracting apparatus according to claim 1, wherein a direction of extension and contraction of the cylinder is parallel to the axial direction of the coupling pin.

5. The coupling pin extracting apparatus according to claim 1, wherein the axial direction of the coupling pin is a direction which is orthogonal to a longitudinal direction of a main body portion of the working machine and is horizontal.

6. The coupling pin extracting apparatus according to claim 1, wherein the frame is attached to the first coupling body to be rotatable around a rotation axis extending in a direction orthogonal to the axial direction, the frame being capable of changing a posture thereof along with rotation around the rotation axis between a projected posture of projecting from the first coupling body in the axial direction by a predetermined amount of projection, the projected posture being a posture where the space portion accepts the coupling pin, and a stored posture of projecting from the first coupling body in the axial direction by an amount of projection smaller than the amount of projection of the projected posture.

7. The coupling pin extracting apparatus according to claim 6, further comprising a fixing member detachably attached to the frame and capable of fixing the frame to the first coupling body.

8. The coupling pin extracting apparatus according to claim 6, wherein the axial direction of the coupling pin is a direction which is orthogonal to a longitudinal direction of a main body portion of the working machine and is horizontal.

9. A working machine comprising:

a main body portion including a slewing frame;

a boom attached to the slewing frame in a raisable and lowerable manner;

a boom foot pin which couples the slewing frame and the boom to enable the boom to be raised and lowered; and the coupling pin extracting apparatus according to claim 1, wherein the first coupling body includes the slewing frame, the second coupling body includes the boom, the coupling pin includes the boom foot pin, the boom foot pin is designed to be inserted into the pin holes opened in the slewing frame and a base end portion of the boom, and the coupling pin extracting apparatus extracts the boom foot pin from the pin hole.

10. A coupling pin extracting apparatus provided in a working machine including a first coupling body and a second coupling body each having a pin hole opened therein, the second coupling body being arranged adjacent to the first coupling body, and a coupling pin inserted into the pin holes to couple the first coupling body and the second coupling body, the coupling pin extracting apparatus extracting the coupling pin from the pin hole in an axial direction, the coupling pin extracting apparatus comprising:

a frame attached to the first coupling body to be opposed to the pin hole on a side opposite to the second coupling body in the axial direction of the coupling pin, the frame defining a space portion which accepts the coupling pin extracted from the pin hole;

a plurality of cylinders extensible and arranged to be opposed to the space portion in a direction orthogonal to the axial direction, each of the plurality of cylinders including a cylinder fixed portion which is fixed to the frame, and a cylinder movable portion which is fit on the cylinder fixed portion and is movable relative to the cylinder fixed portion; and a connection member which connects the coupling pin and the cylinder movable portion with each other and operable to extract the coupling pin from the pin hole along the axial direction while guiding the coupling pin to the space portion in association with extension operation of the cylinder caused by relative movement of the cylinder movable portion, wherein the plurality of cylinders includes at least a pair of cylinders, and the paired cylinders are arranged on both sides in a radial direction with the coupling pin sandwiched there between when viewed from the axial direction of the coupling pin.

11. A coupling pin extracting apparatus provided in a working machine including a first coupling body and a second coupling body each having a pin hole opened therein, the second coupling body being arranged adjacent to the first coupling body, and a coupling pin inserted into the pin holes to couple the first coupling body and the second coupling body, the coupling pin extracting apparatus extracting the coupling pin from the pin hole in an axial direction, the coupling pin extracting apparatus comprising:

a frame attached to the first coupling body to be opposed to the pin hole on a side opposite to the second coupling body in the axial direction of the coupling pin, the frame defining a space portion which accepts the coupling pin extracted from the pin hole;

a plurality of cylinders extensible and arranged to be opposed to the space portion in a direction orthogonal to the axial direction, each of the plurality of cylinders including a cylinder fixed portion which is fixed to the frame, and a cylinder movable portion which is fit on the cylinder fixed portion and is movable relative to the cylinder fixed portion; and a connection member which connects the coupling pin and the cylinder movable portion with each other and operable to extract the coupling pin from the pin hole along the axial direction while guiding the coupling pin to space portion in association with extension operation of the cylinder caused by relative movement of the cylinder movable portion, wherein the plurality of cylinders is arranged in radially symmetric positions with each other with respect to a coupling pin central axis of the coupling pin when viewed from the axial direction of the coupling pin.

* * * * *